US006516728B1

(12) United States Patent
Müller et al.

(10) Patent No.: US 6,516,728 B1
(45) Date of Patent: Feb. 11, 2003

(54) CONTINUOUSLY WIDTH-ADJUSTABLE TROLLEY TRAVELLING WINCH

(75) Inventors: Richard Müller, Gaisbach (DE); Johann Lung, Künzelsau (DE); Manfred Finzel, Künzelsau (DE)

(73) Assignee: R. Stahl Fordertechnik GmbH (DE)

( * ) Notice: Subject to any disclaimer, the term of this patent is extended or adjusted under 35 U.S.C. 154(b) by 0 days.

(21) Appl. No.: 09/230,270

(22) PCT Filed: Jul. 17, 1997

(86) PCT No.: PCT/DE97/01510

§ 371 (c)(1),
(2), (4) Date: Jun. 20, 1999

(87) PCT Pub. No.: WO98/04445

PCT Pub. Date: Feb. 5, 1998

(30) Foreign Application Priority Data

Jul. 24, 1996 (DE) ..... 196 29 785

(51) Int. Cl.[7] ..... E61B 3/00
(52) U.S. Cl. ..... 104/94; 104/137; 105/154
(58) Field of Search ..... 104/94, 95, 107, 104/106, 109, 93, 137; 105/148, 154, 155

(56) References Cited

U.S. PATENT DOCUMENTS

| | | | | | |
|---|---|---|---|---|---|
| 3,017,958 | A | * | 1/1962 | Richter | 104/95 |
| 4,062,293 | A | * | 12/1977 | Davis | 104/113 |
| 4,343,240 | A | * | 8/1982 | Nishimura | 105/54 |
| 4,561,359 | A | * | 12/1985 | Duce | 104/94 |
| 5,074,423 | A | * | 12/1991 | Smith | 212/135 |
| 5,664,502 | A | * | 9/1997 | Wilhelm | 105/30 |

FOREIGN PATENT DOCUMENTS

| | | | | | |
|---|---|---|---|---|---|
| AU | WO 83/01435 | | * | 4/1983 | B66C/11/06 |
| DE | 400810 | | * | 8/1924 | 105/154 |
| DE | 83 36 301 | | | 2/1984 | |
| DE | 8336301 | U | * | 2/1984 | E66C/11/06 |
| DE | 8336301 | U1 | * | 3/1984 | |
| DE | 34 18 800 | | | 8/1985 | |
| DE | 37 10 346 | | | 10/1988 | |
| DE | 90 00 600 | | | 3/1990 | |
| DE | 94 07 566 | | | 7/1994 | |
| DE | 43 21 758 | | | 1/1995 | |
| GB | 441942 | A | * | 1/1936 | |
| GB | 441942 | | * | 1/1936 | 105/154 |
| GB | 2 067 490 | | * | 7/1981 | B60L/15/00 |
| GB | WO-8301435 | A1 | * | 10/1982 | |
| GB | WO-83/01435 | A1 | * | 4/1983 | B66C/11/06 |

* cited by examiner

*Primary Examiner*—S. Joseph Morano
*Assistant Examiner*—Frantz F. Jules
(74) *Attorney, Agent, or Firm*—Leydig, Voit & Mayer, Ltd.

(57) ABSTRACT

In a travelling trolley assembly, the two side frame bars (6, 7) which extend on either side of the running rail (2) are connected to one another via two connecting columns (8). The connecting columns (8) are smooth and cylindrical on the outside are fitted into receiving or sliding-guidance devices which are formed in the side frame bars (6, 7) below the running rail (2). In order to adjust the distance between the two side frame bars (6, 7) and to fix the distance which has been set, receiving devices, through which a threaded rod (46) which is parallel to the connecting column (8) passes, are situated in the vicinity of the connecting columns (8). The distance is adjusted and fixed with the aid of screw threads (94, 95), preferably lock nuts, which rest on the connecting rod (46). This type of fixing arrangement does not damage the shape of the guide columns (8), so that dismantling is easy to carry out at any time.

27 Claims, 4 Drawing Sheets

CONTINUOUSLY WIDTH-ADJUSTABLE TROLLEY TRAVELLING WINCH

BACKGROUND OF THE INVENTION

Field of the Invention

Travelling trolley assemblies of hoisting appliances run along rails, which are often formed by I-sections. The dimensions of these parts are standardised.

The size of the cross-sectional dimensions of the I-section depends on the maximum carrying force and the width spanned. I-sections of different widths are used even where hoisting appliances with identical carrying forces are used. Since the bottom flange of the I-section passes through the trolley assembly, the distance between the two frame halves varies in accordance with the width of the bottom flange of the section in question.

In order to be able to adjust the travelling trolley assembly to I-sections of different widths, it is known, for example from DE 34 18 800 C1, to couple together the two wheel carriers which essentially form the trolley assembly by means of a cylindrical connecting column. For this purpose, each of the wheel carriers contains a cylindrical bore which is parallel to the axis of rotation of the running wheels. The connecting column in question passes through this bore. In this way, it is possible to adjust the width continuously as desired by displacing the wheel carriers on the connecting column.

In order to secure the wheel carriers axially with respect to the connecting column, so that they cannot move apart from one another, transverse bores are present in each of the wheel carriers, which bores intersect the receiving bore for the connecting column and run at right angles to this bore. In the transverse bore there is a wedge which is provided with cutting ribs and is secured by a pressure screw. When the pressure screw is tightened, the ribs of the wedge cut into the circumferential surface of the connecting column and thus fix the wheel carrier in question on the connecting column.

When the wedge cuts into the connecting column, material is in principle thrown up from this column so as to project beyond the outer circumference. This projecting material represents a considerable obstacle to disassembly if it is intended, for the purpose of removing the travelling trolley assembly from the running rail, to pull the wheel carriers apart along the connecting column. The material which has been thrown up becomes jammed in the receiving bore for the connecting column.

In another embodiment of a travelling trolley for hoisting appliances with accordance with DE-U 83 36 301, the two wheel carriers are connected to one another via at least one threaded rod and a cylinder pin. The cylinder pin is provided at both its ends with threaded studs which are of smaller diameter and pass through corresponding bores in the wheel carriers. The width of the trolley assembly is adjusted by inserting a greater or smaller number of shims between the wheel carrier and the shoulder at which the cylinder pin becomes the threaded stud in question. This design therefore does not provide a description of a continuous adjustment of the width of the trolley assembly. Furthermore, assembly is not always easy.

The threaded pin is situated between the cylinder pin and the travelling assembly rail. The torque stemming from the normal forces of the wheels leads to a tensile stress in the threaded rod and a compressive stress in the cylinder pin which is of significant larger diameter. However, these conditions are only accurately present if the correct width has been set with the aid of lock nuts on the threaded rod. This requires a corresponding level of care which cannot always be guaranteed at the assembly site. However, if the setting tolerances are not precisely observed, the calculated load values do not correspond to the actual load values.

In a solution for a travelling trolley assembly which is known from DE-30 42 225 C2, the connecting column is provided on the outside with a screw thread. One of the two wheel carriers contains a rigidly attached threaded nut for accommodating the connecting column, which is screwed through this nut. That end of the connecting column which is adjacent to the other wheel carrier is cylindrical and smooth and is fitted into a corresponding cylindrical receiving opening. With the aid of a transverse pin which passes through the receiving opening and the connecting column, the connecting column is prevented from rotating about its axis and from sliding out of the receiving device in question.

By rotating the connecting column, the two wheel carriers are screwed towards one another or moved away from one another.

The manufacturing costs for this solution are high. It is not readily possible to provide the connecting column with a suitable threaded profile which runs with a narrow tolerance in the threaded nut of the one wheel carrier. At any rate, the connecting column has to absorb considerable flexural forces which arise because the running wheels, under load and when interacting with the bottom flange of the rails, seek to move the two wheel carriers apart.

In this case, the spline-like grooves which are formed by the screw thread undercuts increase the risk of fatigue cracking of the connecting column as a result of the notch effect emanating from the grooves.

In another embodiment of a travelling trolley for hoisting appliances in accordance with DE-U 83 36 301, the two wheel carriers are connected to one another via at least one threaded rod and a cylinder pin. The cylinder pin is provided at both its ends with threaded studs which are of smaller diameter and pass through corresponding bores in the wheel carriers. The width of the trolley assembly is adjusted by inserting a greater or smaller number of shims between the wheel carrier and the shoulder at which the cylinder pin becomes the threaded stud in question. A continuous adjustment of the width of the trolley assembly is therefore impossible. Furthermore, assembly is complicated.

The threaded pin is situated between the cylinder pin and the travelling assembly rail. The torque stemming from the normal forces of the wheels leads to a tensile stress in the threaded rod and a compressive stress in the cylinder pin which is of significant larger diameter. However, these conditions are only accurately present if the correct width has been set with the aid of lock nuts on the threaded rod. This requires a very high level of care which cannot always be guaranteed at the assembly site. However, if the setting tolerances are not precisely observed, the calculated load values do not correspond to the actual load values.

OBJECT AND SUMMARY OF THE INVENTION

On the basis of the above considerations, the object of the invention is to provide a travelling trolley assembly of adjustable width which is easy to mount and disassemble.

This object is achieved according to the invention by means of the travelling trolley assembly having the features of claim 1.

Since in the novel travelling trolley assembly threaded rods are used to lock the side frame bars on the connecting column, it is possible to use a smooth cylindrical connecting column which is not damaged even when used to lock the side frame bars. Any dismantling operation which may be required is correspondingly easy. Furthermore, it is possible to use side frame bar designs in which there is no space which would easily allow transverse wedges to be accommodated for fixing purposes. For example, in the case of box-shaped designs for the side frame bars, there would be no possibility of using wedges such as those which are known from the prior art for locking purposes. By contrast, the use of a threaded rod for the continuous adjustment as desired to the distance between the two side frame bars is readily possible.

The manufacturing cost of the side frame bars is reduced if these are of identical design or at least are mirror images of each other.

In order to allow the side frame bar to be adjusted easily on the connecting column in question, the side frame bar contains a suitable sliding-guidance device. In the most simple case, this sliding-guidance device comprises two openings which are aligned with one another, are spaced apart from one another, are coaxial with respect to one another and are formed in walls of the frame unit. This embodiment favours box-like sections for producing the frame units. It is possible to make use of the considerable advantages of box-like sections, which consist in the fact that they are significantly lighter than solid structural components of the same load-bearing capacity.

Description of the Related Art

In order to facilitate assembly, it is advantageous if one of the two side frame bars is connected to the connecting column in an essentially nondisplaceable manner. The receiving device for the connecting column may in this case be of similar design to the sliding-guidance device, in which case it is merely necessary in addition to provide an axial securing means for the connecting column.

A very simple axial securing means is obtained if the connecting column is provided at one end with a tangential groove which is formed in the transverse direction and in which a platelike securing element which is screwed onto the side frame bar in question engages.

The threaded rod may be a commercially available threaded rod and is advantageously attached to the side frame bars with the aid of locked nuts. For this purpose, each side frame bar contains a corresponding bore as a receiving device for the threaded rod.

If box sections are used for the side frame bar, it is advantageous if the opening through which the threaded rod passes is assigned a further opening, via which a tool for actuating or holding the nut situated in the frame can be introduced.

In order to allow the travelling trolley assembly to move along the running rail under its own power, a traction motor, which is preferably designed as a geared motor, is flanged onto one side frame bar. If it is intended to drive running wheels on both sides of the running rail using the traction motor, the output shaft is preferably designed as a profiled shaft on which there are drive pinions which are longitudinally displaceable but rotationally fixed. The drive pinions mesh with gearwheels which are rotationally fixed to the running wheels in question. Owing to the fact that the pinions can be displaced along the transmission output shaft, the desired width adjustability of the travelling trolley assembly is not impeded by the pinions on the transmission output shaft.

The width adjustment and assembly are particularly simple if the pinions are mounted in an axially nondisplaceable but routable manner in each of the two side frame bars.

BRIEF DESCRIPTION OF THE DRAWINGS

An exemplary embodiment of the subject matter of the invention is illustrated in the drawing, in which:

FIG. 1 depicts a travelling trolley mechanism 1 which is intended to run along a running rail 2. The running rail 2 comprises an I-section with a top flange 3, a bottom flange 4 and a straight web 5 which connects the two flanges to one another. The travelling trolley assembly 1 runs along the top side of the bottom flange 4.

Figure 1:
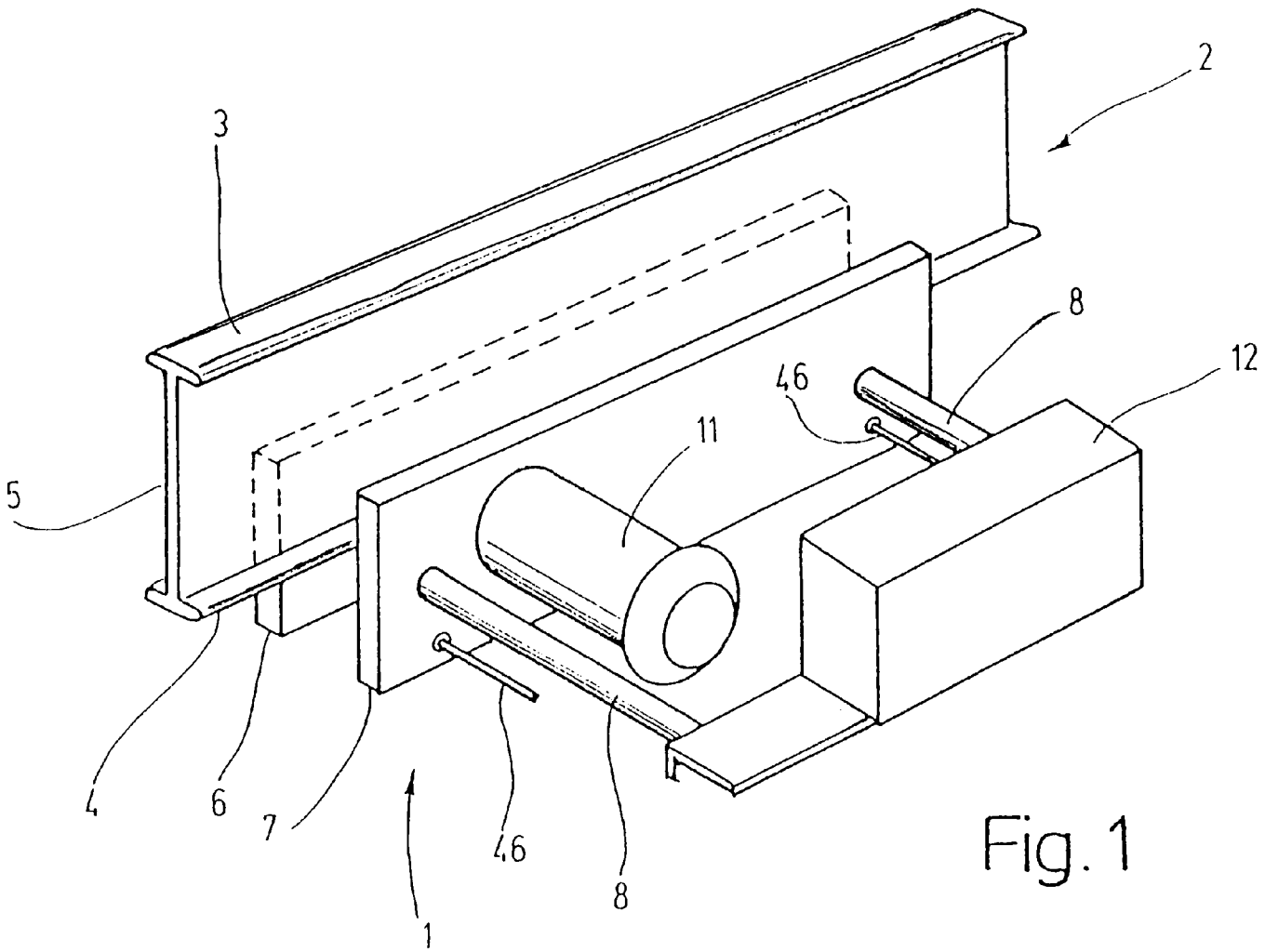
FIG. 1 shows a highly diagrammatic, prespective illustration of a travelling trolley assembly.

The main components of the travelling trolley assembly 1 include two side frame bars 6, 7 which are arranged parallel to and at a distance from one another, between which the running rail 2 extends and which are connected to one another via two connecting columns 8 which are parallel to one another. In order to simplify the drawing, the side frame bars 6, 7 are illustrated as continuous side frame bars. Without altering the essence of the invention, the side frame bars 6, 7 could also be discontinuous and could instead comprise a plurality of parts or sections.

Figure 2:
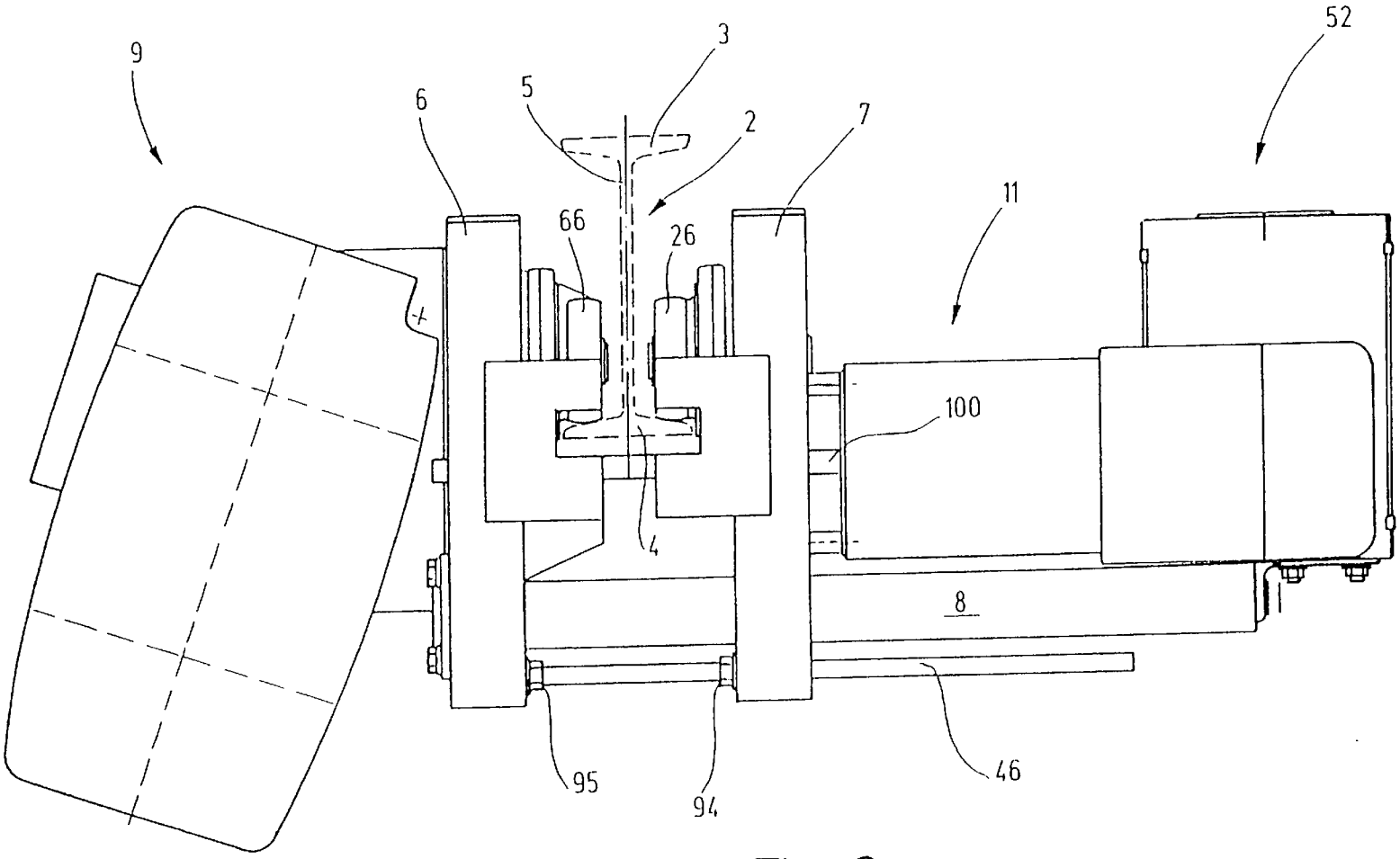
FIG. 2 shows an end view of the travelling trolley assembly in accordance with FIG. 1.

As can be seen from FIG. 2, a cable line 9 is attached to the side frame bar 6 situated behind the running rail 2 on the side facing away from a person looking at FIG. 1. The other side frame bar 7 is provided with a drive motor 11 and a counterweight 12.

The two side frame bars 6, 7 are mirror images of one another or may even be identical apart from attachment bores for the drive motor 11 and the cable line 9. At least in the region of the connecting columns 8, they are designed as hollow box sections.

Figure 3:
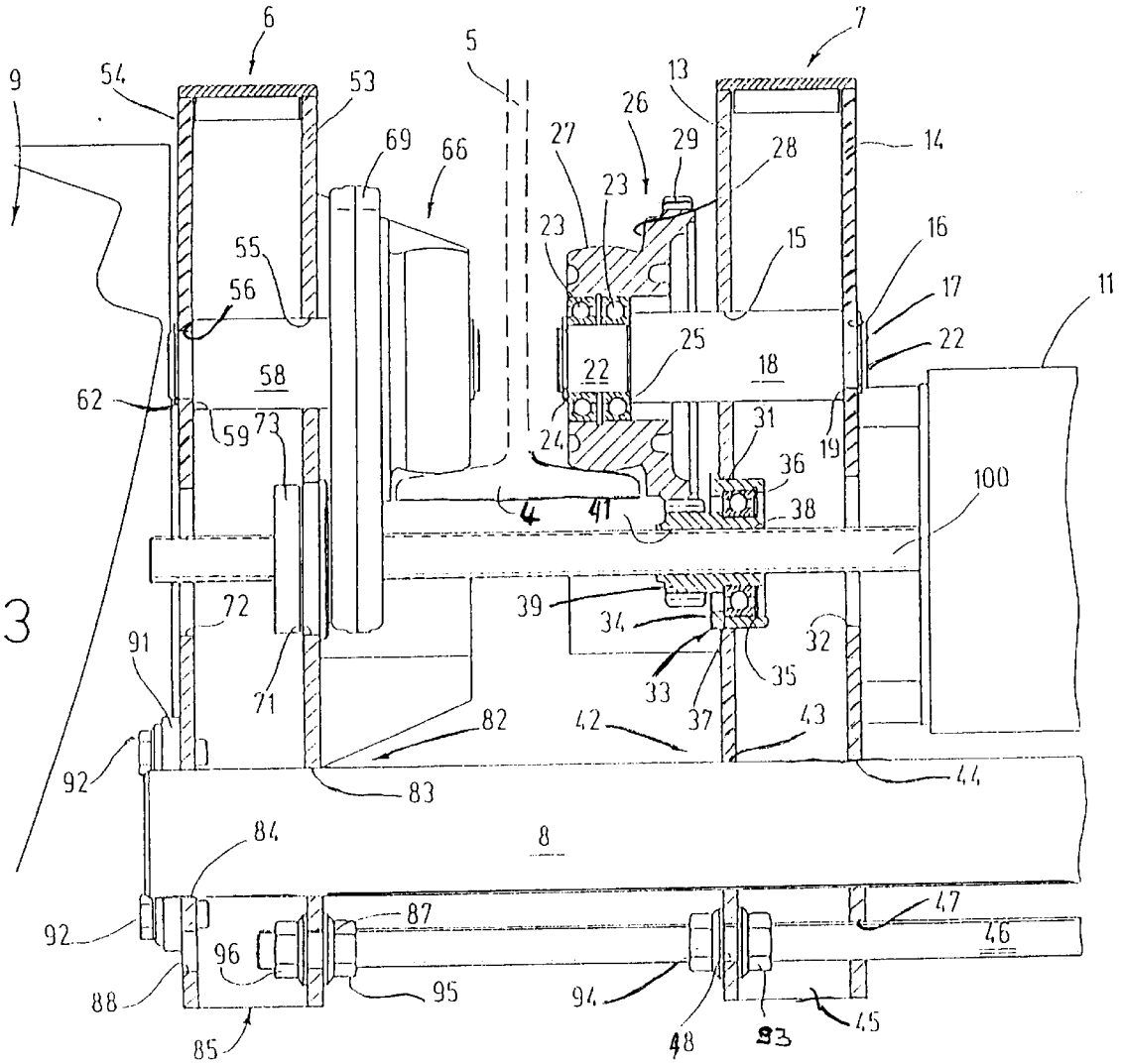
FIG. 3 shows a cross section through the travelling trolley assembly in accordance with FIG. 1, the section lying at the level of one of the two connecting columns.
Figure 4:
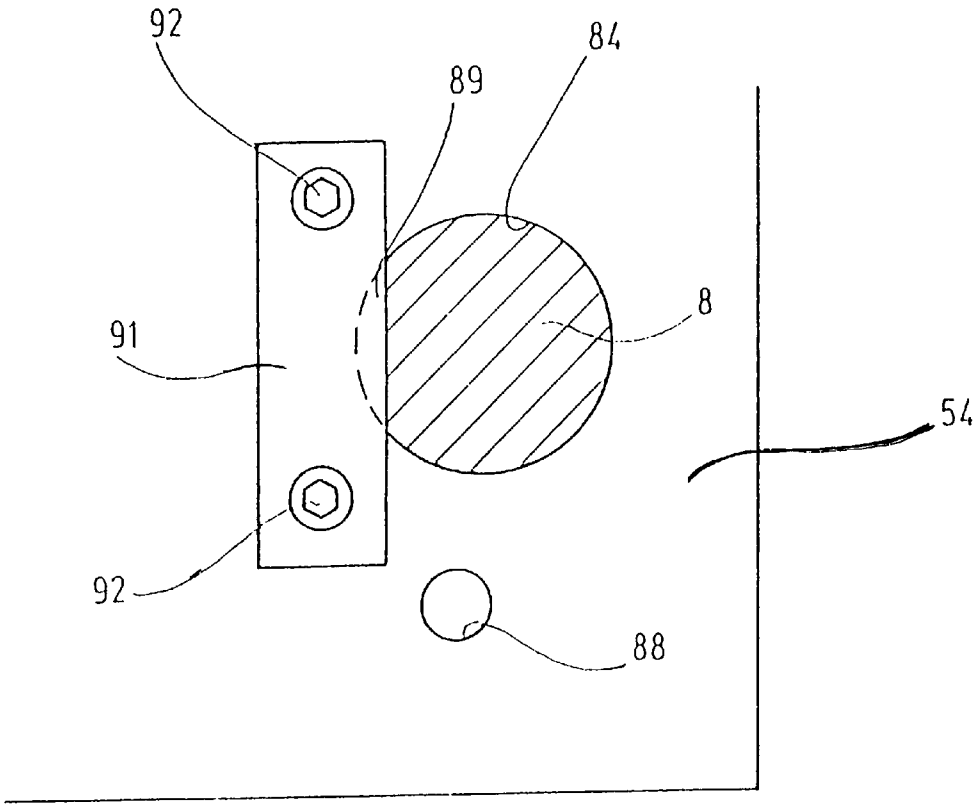
FIG. 4 shows a plan view of the axial securing means for the connecting column.

As can be seen from FIG. 3, the side frame bar 7, at least in the region of the two connecting columns 8, has two side walls 13 and 14 which are at a distance from one another and are connected to one another. The side wall 13, which is adjacent to the running rail 2, in this case forms the inner side wall, while the other side wall 14 is consequently the outer side wall. The two side walls 13 and 14 extend parallel to the running rail 2 and are essentially straight.

Somewhat below the top edge of the side frame bar 7, the inner side wall 13 is provided with a bore 15 which is coaxial with respect to a bore 16 in the outer side wall 14. The bore 16 has a slightly smaller diameter than the bore 15. It serves to accommodate a cylindrical extension 17 of a cylindrical axial journal 18 which, starting from the bore 16, penetrates through the bore 15, which is aligned with said bore 16, essentially without play.

Via a plane shoulder 19, the cylindrical extension 17 merges into the axial journal 18 and bears against the inside of the outer side wall 14 by way of this plane shoulder 19. The outside of the cylindrical extension 17 is provided with a circumferential annular groove in which a circlip 21 is fitted as an axial securing means.

The longitudinal axis of the axial journal 18 is perpendicular to the plane defined by the web 5, and said journal projects toward the opposite side frame bar 6. Two ball bearings 23 rest on a cylindrical extension 22 of this section of the axial journal 18 projecting beyond the side frame bar 7. The ball bearings are secured axially between a circlip 24 and an annular shoulder 25. The annular shoulder 25 is situated at the transition between the narrowed extension 22 and the wider part of the axial journal 18.

With the aid of these ball bearings 23, a running wheel 26 is mounted rotatably on the axial journal 18, which running wheel has a barrel-shaped or ball-shaped running surface 27 and an adjoining wheel flange 28.

The wheel flange 28, which is adjacent to the side frame bar 7, merges into a gearwheel 29 on this side.

Behind the running wheel 26 which can be seen in FIG. 3 there is a second running wheel which is mounted axially parallel with and in the same way as the running wheel which can be seen. This only differs from the running wheel 26 illustrated by the fact that the gearwheel 29 is not present.

Directly below the bore 15, the inner side wall 13 has a larger bore 31 which is aligned with a corresponding bore 32 in the outer side wall 14. A flanged sleeve 33, the flange 34 of which bears against the outside of the inner side wall 13, is pressed into the bore 31. The flanged sleeve 33 serves as a seat for a grooved ball bearing 35 which is accommodated therein and is in turn secured, by means of a circlip 36, in the flanged sleeve 33 between the circlip and a shoulder 37 which protrudes radially inward.

The axis of the grooved ball bearing 35 runs parallel to the axis of the axial journal 18.

The grooved ball bearing 35 is used to support a hollow shaft 38 which is formed integrally on a pinion 39. The pinion 39 meshes with the gearwheel 29.

The hollow shaft 38 is axially secured in the grooved ball bearing 35 with the aid of a further circlip, which cannot be seen in the figure.

A through-bore 41 which is provided with profiled toothing passes through both the pinion 39 and the hollow shaft 38.

Further below the pinion 39, the side frame bar 7 has a sliding-guidance device 42 for the connecting column 8. The sliding-guidance device 42 comprises two mutually coaxial openings 43 and 44 which are situated in the inner and outer side walls 13, 14, respectively. The openings 43 and 44 are spaced apart from one another by the same distance as that which lies between the two side walls 13 and 14. The openings have the same cross-sectional shape as the cross section of the connecting column 8. The connecting column 8 is preferably cylindrical, and therefore the two openings 43 and 44 are also circular openings with a diameter which is slightly greater than the external diameter of the connecting column 8.

A further sliding-guidance device, the design of which corresponds to the sliding-guidance device 42 illustrated, is situated, with regard to FIG. 3, behind the sliding-guidance device 42 which can be seen in that figure, at that point where the other connecting column 8, which can be seen in FIG. 1, extends.

A receiving device 45 for a threaded rod 46 is provided in the side frame bar 7 below the sliding-guidance device. The receiving device 45 comprises two mutually aligned bores 47 and 48 in the inner and outer side walls 13, 14, respectively. Below the receiving device, the side frame bar 7 is open at the bottom.

A threaded rod 46 and an associated receiving device 45 are also provided for the second connecting column 8, which cannot be seen in FIG. 3.

With regard to the description which has been given so far, the other side frame bar 6, to which the cable line 9 is attached, is essentially of mirror-symmetrical design. At least in the region of the two connecting columns 8, the side frame bar 6 is designed as a hollow box section and has two side walls 53 and 54 which are parallel to one another and are arranged at a distance from one another. The inner side wall 53 contains a bore 55 which is coaxial with respect to the bore 15 and with which a bore 56 in the outer side wall 54 is aligned. These two bores 55, 56 serve to attach an axial journal 58 which faces toward the other axial journal 18 and is coaxial with respect to the latter. The axial journal 58 is secured axially in the outer side wall 54 with the aid of a circlip 62 and an annular shoulder 59, in the same way as the axial journal 18. A further running wheel 66, the structure of which is identical to the running wheel 26, is rotatably mounted on that part of the axial journal 58 which projects beyond the inner side wall 53. The gearwheel of this running wheel is protected by means of a cover 69. A corresponding cover is also situated above the gearwheel 29, but has not been shown in the drawing for reasons of clarity.

Below the bore 55 there is a bore 71 which corresponds to the bore 31 and into which a flanged sleeve 73 is fitted, said flanged sleeve serving as a seat for a ball bearing (not shown). This bore 71 is aligned with the bore 31 in the other side frame bar 7 and with a bore 72 in the outer side wall 54.

The ball bearing which rests in the flanged sleeve 73 is used to rotatably mount a pinion, which is identical to the pinion 39 and meshes with the gearwheel of the running wheel 66. Owing to the fact that the cover 69 has not been opened up in the drawing, this pinion assigned to the side frame bar 6 cannot be seen in the drawing.

A similar sliding-guidance device 82, which corresponds to the sliding-guidance device 42 of the side frame bar 7 and is composed of the same design elements, namely an opening 83 in the inner side wall 53 and an opening 84 in the outer side wall 54, similarly serves as a receiving device. These two openings 83 and 84 are circular and are coaxial with respect to one another and with respect to the openings 43 and 44. Their diameter is the same as the external diameter of the connecting column 8.

The side frame bar 6 also has a second running wheel which is axially parallel with respect to the visible running wheel 66 and is situated immediately behind the latter, so that it is covered by the visible running wheel 66. Also, a sliding-guidance device 82 for the other connecting column 8 is situated below the further running wheel which cannot be seen.

Below the sliding-guidance device 82, there is a receiving device 85 which corresponds to the receiving device 45 and comprises two bores 87 and 88 in the inner and outer side walls 53, 54, respectively.

In order to secure the connecting column 8 axially in the receiving or sliding-guidance device 82, the connecting column 8 contains, at its end which projects beyond the outer side wall 54, a tangential groove 89 of rectangular cross section. An elongate securing spring 91, which is also rectangular in cross section and is screwed fixedly onto the outside of the outer side wall 54 with the aid of two screws 92, rests in this groove 89.

The travelling trolley assembly 1 which has been described above is assembled as follows:

The flanged sleeves 33 and 73, with the grooved ball bearings resting therein, are pressed into the prepared side frame bars 6 and 7 which have been provided with the corresponding bores and openings. Then, the pinions 39 are fitted into the grooved ball bearings in the flanged sleeves 33 and 73 and are secured therein. The axial journals 18 and 58, of which there are four in total and onto which the ball bearings 23, together with the running wheels 26 and 66, respectively, are fitted, can now be mounted in the side frame bars 6 and 7. To do this, the axial journals 18 and 58 are pushed in through the opening 15 until the cylindrical extension 17 can be seen outside the outer side walls 14 and 54, respectively. By inserting the circlips 22, the axial journals 18 and 58 are axially secured. The transverse forces which subsequently occur in operation are absorbed by the walls of the two bores 15 and 16 and 55 and 56, respectively.

Thus each of the two side frame bars 6, 7 is equipped with two running wheels, in each case one running wheel being provided with a gearwheel 29 which meshes with the associated pinion 39. After the side frame bars 6, 7 have been prepared to this extent, two continuously cylindrical connecting columns 8 are fitted into the two sliding-guidance devices or receiving devices 82, which are aligned parallel to one another, of the side frame bar 6 which subsequently bears the cable drum. The connecting columns 8 have a cross section which is constant over their entire length and are smooth on their outer side. They pass through the bores 83 and 84 with a suitably low level of play.

The insertion movement of the connecting columns 8, which are introduced from the openings 83, is continued until the tangential, rectangular groove 89 is just visible on the outside of the outer side wall 54. The connecting column 8 in question is then, if necessary, suitably rotated so that the securing spring 91 can engage in the groove 89 from the side and the two tap screws 92 can be fitted through corresponding bores in the securing spring and can be screwed into the threaded bore in the outer side wall 54.

The side frame bar 6 is in this way provided with two connecting columns 8 which run parallel to one another and, in addition, are parallel to the axes of rotation of the running rollers 66 of the side frame bar 6.

The other side frame bar 7 is now pushed onto the connecting columns 8 from that end of the connecting columns 8 which is still free. In this process, the connecting columns slide through the two sliding-guidance devices 42 which are axially parallel with respect to one another. The travelling trolley assembly which has been prepared in this way can be fitted over the bottom flange 4 from below, since the connecting columns 8 are sufficiently long for the gap between the parts which are attached to the two side frame bars 6, 7 to be large enough to allow the flange 4 to fit in. After the flange has been lowered down between the side frame bars 6, 7, the running rollers 66 of the side frame bar 6, for example, are placed on the top side of the flange 4. Then, the other side frame bar 7 on the connecting columns 8 is pushed onto the running rail 2 until the wheels of the side frame bar 7 are also able to rest on the flange 4.

Then, the threaded rod 46 below the collecting column 8 is fitted into the associated receiving devices 45 and 85. To do this, the threaded rod 46 is fitted, to a certain extent, through the opening 47 from the right, as seen in FIG. 3. As soon as the free end appears between the two side walls 13, 14, a threaded nut 43 is screwed on after it has been introduced from below between the side walls 13, 14. By rotating the threaded rod 46 and simultaneously holding the threaded nut 43 in place, the threaded rod 46 gradually moves toward the side frame bar 6. As soon as the threaded rod 46 projects sufficiently far beyond the inner side wall 13, two further threaded nuts 94 and 95 are also screwed onto the threaded rod 46. Then, rotation of the threaded rod 46 is continued while the threaded nut 93 is simultaneously held in place until the free end of the threaded rod 46 extends through the bore 87 into the space between the two side walls 53 and 54.

Finally, a fourth threaded nut 96 is screwed onto that part of the threaded rod 46 which projects through the bore 87.

As is shown, the two threaded nuts 95 and 96 are now rotated towards one another or are locked on the threaded rod 46 with respect to one another, with the side wall 53 between them. As a result, the threaded rod 46 is fixed in the side frame bar 6. The same process is then carried out with the two threaded nuts 93 and 94. In doing so, it is to be ensured that the threaded nut 94 is situated at a position on the threaded rod 46 in which, when the side wall 13 bears against the threaded nut 94, the two side frame bars 6, 7 are at the desired correct distance from one another. In this position, the running surfaces 27 rest on the flange 4 on both sides of the web 5 and the wheel flange 28 is situated in the immediate vicinity to side edges of the flange 4. After the adjustment has been carried out to this extent, the second threaded nut 93 is also tightened until it is secure, with the result that the inner side wall of the side frame bar 7 is fixed between the two threaded nuts 93 and 94.

Since the travelling trolley assembly, as shown in FIG. 1, is provided at both ends, with regard to the direction of travel, with connecting columns 8 and corresponding threaded rods 46 running parallel thereto, the same procedure is carried out at both ends of the travelling trolley assembly 1. Thus the distance between the two side frame bars 6, 7 is also fixed at both ends of the travelling trolley assembly 1.

As can clearly be seen, it is possible by varying the position of the threaded nut 94 on the threaded rod 46, to set any desired trolley assembly width, corresponding to the width of the flange 4, which lies within the adjustment travel provided. The sliding-guidance 42 acts as a sliding guide which is essentially free of clamping and allows the side frame bar 7 to move freely on the connecting column 8 in question. The setting achieved is fixed by locking the two threaded nuts 93, 94 at the appropriate position.

After the travelling trolley assembly 1 has been attached to the running rail 2 in the manner described, finally the cable line 9 is attached to the side frame bar 6 and the drive motor 11 is screwed fixedly onto the side frame bar 7, the transmission output shaft 100 of this motor passing through the mutually aligned drive pinions 39. The output shaft 100 is provided with toothing which is complementary to the profiled toothing 41, so that the output shaft 100 can be fitted freely through the two pinions 39 while at the same time producing a rotationally fixed connection between the output shaft 100 and the pinions 39.

Finally, the counterweight 12 is arranged on the free projecting ends of the two connecting columns 8.

Dismantling is carried out in the same way but in the reverse order.

In a travelling trolley assembly, the two side frame bars, which run on either side of the running rail, are connected to one another via two connecting columns. The connecting columns are smooth and cylindrical on the outside and fit into receiving or sliding-guidance devices which are formed in the side frame bars below the running rail. In order to adjust the distance between the two side frame bars and to fix the distance which has been set, receiving devices, through which a threaded rod which is parallel to the connecting column in question passes, are situated in the vicinity of the connecting columns. The distance is adjusted and fixed with the aid of screw thread means, preferably counternuts, which rest on the connecting rod. This type of fixing arrangement does not damage the shape of the guide columns, so that dismantling is easy to carry out at any time.

What is claimed is:

1. A traveling trolley assembly for hoisting appliances comprising:

a first side frame bar spaced apart from a second frame bar;

a running rail extending between said frame bars;

a first wheel mounted on said first side frame bar and a second wheel mounted on said second side frame bar, said wheels rotating axially parallel to each other;

a connecting column extending between said first frame bar and said second frame bar, said connecting column being disposed at a location below said first and second wheels and having a longitudinal axis parallel to the axis of rotation of said first and second wheels; said frame bars each being formed with an opening for mounting on said column, said connecting column having a smooth cylindrical outer surface section for permitting selected positioning of at least said first frame bar over said smooth cylindrical surface section into predetermined spaced relation to said second frame bar;

a threaded rod adjacent the connecting column having a longitudinal axis and being supported between said first and second frame bars with the longitudinal axis thereof disposed at a level below the longitudinal axis of said connecting column, and said threaded rod being operable for securing the first and second frame bars in predetermined spaced position on said connecting column.

2. The traveling trolley assembly according to claim 1, wherein the running rail includes a top flange, a bottom flange and a straight web connecting the top flange to the bottom flange.

3. The traveling trolley assembly according to claim 2, wherein the distance between the first side frame bar and the second side frame bar is adjusted by varying the position of the second threaded nut to a desired trolley assembly width corresponding to the width of the bottom flange.

4. The traveling trolley assembly according to claim 1, wherein the first side frame bar is substantially identical to the second side frame bar.

5. The trolley assembly of claim 4 including first and second thread nuts mounted on said threaded rod in opposing relation to each other with at least a portion of said first frame bar therebetween for securing said first frame bar in fixed relation to said threaded nut, and said column.

6. The trolley assembly of claim 5 including third and fourth threaded nuts mounted on said threaded rod in opposing relation to at least a portion of said second frame bar for securing said second frame bar in fixed relation to said threaded rod and to said column.

7. The trolley assembly of claim 6 in which said first frame bar has a wall clamped in predetermined position on said threaded rod between said first and second threaded nuts, and said second frame bar has a wall clamped in predetermined position on said threaded rod between said third and fourth threaded nuts.

8. The traveling trolley assembly according to claim 6, wherein the first threaded nut is adjacent an inner side of the wall of the first side frame bar, the second threaded nut is adjacent an outer side of the wall of the first side frame bar, the third threaded nut is adjacent an outer side of the wall of the second side frame bar, and the fourth threaded nut is adjacent an inner side of the wall of the second side frame bar.

9. The traveling trolley assembly according to claim 6, wherein the third and the fourth threaded nuts are rotated towards each other to lock the first and the second threaded rods in place relative to the second side frame bar.

10. The traveling trolley assembly according to claim 6, wherein the first and the second threaded nuts are rotated towards each other to lock the first and second threaded rods in place relative to the first side frame bar.

11. The traveling trolley assembly of claim 1 in which said threaded rod is disposed at a level below said column.

12. The traveling assembly of claim 11 in which said column has a larger diameter than said threaded rod.

13. The trolley assembly of claim 1 in which said column has a smooth cylindrical surface substantially its entire length, and said first and second frame bars both are selectively positionable over said surface into predetermined spaced relation to each other.

14. The trolley assembly of claim 1 including nuts which are threadably engageable with said threaded rod into predetermined relation to said first and second side bars for securing said side bars in predetermined relation to said threaded rod and hence to said column.

15. The trolley assembly of claim 1 in which said threaded rod is in threaded engagement with at least said first frame bar.

16. The trolley assembly of claim 15 in which said threaded bar is in engagement with both said first and second frame bars.

17. A traveling trolley assembly for hoisting appliances comprising:

a first side frame bar spaced apart from a second frame bar;

a running rail extending between said frame bars;

a first wheel mounted on said first side frame bar and a second wheel mounted on said second side frame bar, said wheels rotating axially parallel to each other;

a connecting column extending between said first frame bar and said second frame bar, said extending column being disposed at a location below said first and second wheels and having a longitudinal axis parallel to the axis of rotation of said first and second wheels; said frame bars each being formed with an opening for mounting on said column, said connecting column having a smooth cylindrical outer surface extending substantially the length thereof for permitting selected positioning of at least said first frame bar over said smooth cylindrical surface into predetermined spaced relation to said second frame bar;

a threaded rod having a longitudinal axis and being supported between first and second frame bars and having a longitudinal axis parallel to the axis of said column, and said threaded rod being operable for securing the first and second frame bars in predetermined spaced position on said connecting column.

18. The traveling trolley assembly according to claim 17, wherein a traction motor is attached to one of said side frame bars.

19. The traveling trolley assembly according to claim 18, wherein said traction motor includes an output shaft that passes from one of said frame bars to the other side frame bar.

20. The traveling trolley assembly of claim 17 in which said threaded rod is disposed directly below said column.

21. The traveling assembly of claim 17 in which said column has a larger diameter than said threaded rod.

22. The trolley assembly of claim 17 in which said first and second frame bars both are selectively positionable over said column surface into predetermined spaced relation to each other.

23. The trolley assembly of claim 22 including nuts which are threadably engageable with said threaded rod into predetermined relation to said first and second side bars for securing said side bars in predetermined relation to said threaded rod and hence to said column.

24. A traveling trolley assembly for hoisting appliances comprising:

a first side frame bar spaced apart from a second frame bar;

a running rail extending between said frame bars;

pairs of wheels mounted on said first and second frame bars, each pair including a first wheel mounted on said first frame bar and a second wheel mounted on said second frame bar, said pairs of wheels having parallel axes of rotation;

a pair of connecting columns extending between said first frame bar and said second frame bar, said extending columns being disposed at a location below said pairs of wheels and having longitudinal axes parallel to the axes of rotation of said pairs of wheels;

said first and second frame bars each being formed with an opening for mounting on said columns, said connecting columns each having a smooth cylindrical outer surface extending substantially the length thereof while permitting selective positioning of said first and second frame bars over said smooth cylindrical surface into predetermined spaced relation to each other;

a pair of threaded rods each having a longitudinal axis and being supported between said first and second frame bars with the longitudinal axes thereof each being disposed at a level below the longitudinal axis of a respective one of said columns, and said threaded rods being operable for securing the first and second frame bars in predetermined spaced position on said connecting columns.

25. The traveling trolley assembly of claim 24 in which said threaded rods are disposed at a level below said column.

26. The traveling assembly of claim 25 in which said columns have a larger diameter than said threaded rod.

27. The trolley assembly of claim 24 including nuts which are threadably engageable with said threaded rods into predetermined relation to said first and second side bars for securing said side bars in predetermined relation to said threaded rods and hence to said columns.

* * * * *